US010697208B2

(12) United States Patent
Nishizuka et al.

(10) Patent No.: US 10,697,208 B2
(45) Date of Patent: Jun. 30, 2020

(54) LEVER CONNECTION BODY, ROD HOLDER, AND HANDLE APPARATUS FOR VEHICLE

(71) Applicant: ALPHA CORPORATION, Yokohama-shi, Kanagawa (JP)

(72) Inventors: Mitsuo Nishizuka, Kanagawa (JP); Ryoya Ookuma, Kanagawa (JP)

(73) Assignee: ALPHA CORPORATION, Yokohama-shi, Kanagawa (JP)

( * ) Notice: Subject to any disclaimer, the term of this patent is extended or adjusted under 35 U.S.C. 154(b) by 707 days.

(21) Appl. No.: 15/128,154

(22) PCT Filed: Mar. 23, 2015

(86) PCT No.: PCT/JP2015/058792
§ 371 (c)(1),
(2) Date: Sep. 22, 2016

(87) PCT Pub. No.: WO2015/146934
PCT Pub. Date: Oct. 1, 2015

(65) Prior Publication Data

US 2017/0107745 A1 Apr. 20, 2017

(30) Foreign Application Priority Data

Mar. 24, 2014 (JP) ..... 2014-059589

(51) Int. Cl.
*E05B 79/16* (2014.01)
*E05B 85/18* (2014.01)
(Continued)

(52) U.S. Cl.
CPC ..... *E05B 79/16* (2013.01); *E05B 79/08* (2013.01); *E05B 79/20* (2013.01); *E05B 79/22* (2013.01);
(Continued)

(58) Field of Classification Search
CPC ..... E05B 79/00; E05B 79/08; E05B 79/10; E05B 79/12; E05B 79/16; E05B 79/20;
(Continued)

(56) References Cited

U.S. PATENT DOCUMENTS 4,212,560 A 7/1980 Pufpaff et al.
4,896,906 A * 1/1990 Weinerman ..... E05B 77/265 292/337
(Continued)

FOREIGN PATENT DOCUMENTS

CN A-103628755 3/2014
JP UM-A-S56-127263 9/1981
(Continued)

OTHER PUBLICATIONS

Computer Generated Translation for JP 2000282733, generated on May 23, 2019, https://worldwide.espacenet.com/ (Year: 2019).*
(Continued)

*Primary Examiner* — Alyson M Merlino
(74) *Attorney, Agent, or Firm* — Faegre Drinker Biddle & Reath LLP

(57) ABSTRACT

A lever connection body includes a first lever; and a second lever rotating about a rotation center which is different from a rotation center of the first lever. A sliding long hole opened in the first lever and the second lever spaced apart with respect to the sliding long hole, are connected to each other via a rod. A rod holder including an inserting projection portion inserted into the sliding long hole of the first lever is mounted on an end portion of the rod which is a side of the first lever. A rectangular stopper is provided in a distal end portion of the inserting projection portion of the rod holder, the stopper has a short side length to be inserted into the sliding long hole and a long side portion locked to the sliding long hole to regulate withdrawn from the sliding long hole.

2 Claims, 4 Drawing Sheets

(51) Int. Cl.

| | |
|---|---|
| ***E05B 79/22*** | (2014.01) |
| ***E05B 79/08*** | (2014.01) |
| ***E05B 79/20*** | (2014.01) |
| *E05B 15/00* | (2006.01) |
| *E05B 63/04* | (2006.01) |
| *E05B 17/00* | (2006.01) |
| *E05B 13/00* | (2006.01) |

(52) U.S. Cl.
CPC ..... *E05B 85/18* (2013.01); *E05B 13/005* (2013.01); *E05B 15/0053* (2013.01); *E05B 17/007* (2013.01); *E05B 63/04* (2013.01)

(58) Field of Classification Search
CPC ..... E05B 79/22; E05B 85/18; E05B 13/005; E05B 15/0053; E05B 17/007; E05B 63/04; E05B 83/18; Y10T 292/57; Y10T 292/1048; Y10T 292/1055; Y10T 292/1053; Y10T 292/1076; Y10T 292/108; Y10T 70/5757; Y10T 70/5765; Y10T 70/5805; Y10T 70/5832
See application file for complete search history.

(56) References Cited

U.S. PATENT DOCUMENTS

| | | | | |
|---|---|---|---|---|
| 4,917,412 | A * | 4/1990 | Swan | E05B 77/265 292/216 |
| 5,069,491 | A * | 12/1991 | Weinerman | E05B 77/265 292/216 |
| 5,117,665 | A * | 6/1992 | Swan | E05B 77/265 292/48 |
| 5,765,959 | A * | 6/1998 | Shioda | E05B 79/12 403/192 |
| 2007/0137403 | A1 | 6/2007 | Anscher | |
| 2011/0181055 | A1* | 7/2011 | Hidding | E05B 79/12 292/228 |
| 2014/0054903 | A1 | 2/2014 | Kim et al. | |
| 2017/0009498 | A1* | 1/2017 | Hidaka | E05B 85/18 |

FOREIGN PATENT DOCUMENTS

| | | | |
|---|---|---|---|
| JP | UM-A-S56-157269 | | 11/1981 |
| JP | UM-A-S57-082549 | | 5/1982 |
| JP | S62-118862 | U | 7/1987 |
| JP | S63-102859 | U | 7/1988 |
| JP | H05-64515 | U | 8/1993 |
| JP | H11-13325 | A | 1/1999 |
| JP | A-2000-282733 | | 10/2000 |
| JP | 2001-262876 | A | 9/2001 |
| JP | B2-3903408 | | 1/2007 |
| JP | 2007-224717 | A | 9/2007 |
| JP | B2-4573853 | | 8/2010 |

OTHER PUBLICATIONS

CN Office Action dated Mar. 21, 2018 in Chinese Application No. 201580016041.2 with English language translation.
Extended European Search Report dated Oct. 5, 2017 in corresponding European patent, application 15769412.6 (10 pages).
JP Office Action dated Jan. 16, 2018 in Japanese Application No. 2014-059589 with English language translation.

* cited by examiner

LEVER CONNECTION BODY, ROD HOLDER, AND HANDLE APPARATUS FOR VEHICLE

TECHNICAL FIELD

The present disclosure relates to a lever connection body, a rod holder, and a handle apparatus for a vehicle.

BACKGROUND ART

In the related art, Patent Literature 1 (JP-UM-A-05-064515) discloses a lever connection body which connects a rod to a lever. In the structure of Patent Literature 1, a projection portion of a rod holder which is mounted on a distal end of the rod is inserted into a hole opened in a lock key lever (lever).

An locking pawl which elastically locks to the peripheral edge of the hole is provided in the projection portion of the rod holder, and thus a connection state between a lever and the rod holder is maintained.

In the structure of Patent Literature 1, in a case where the rod is connected to the lever with a translational freedom degree therebetween, that is, in a case where the lever and the rod are connected by inserting the projection portion of the rod holder into a sliding long hole of the lever, since the locking pawl having a small enough locking size to elastically lock to the peripheral edge of the hole is slid along the peripheral edge of the sliding long hole, there is a possibility that the rod which is unlocked from the lever is withdrawn from the lever.

In order to prevent this, interposition of a washer or the like between the lever and the locking pawl is considered. However, in this case, since the interposing work of the washer or the like is required, a problem that the assembling workability is lowered occurs.

CITATION LIST

Patent Literature

[Patent Literature 1] JP-UM-A-05-64515

SUMMARY OF INVENTION

The present disclosure relates to a lever connection body that has good assembling workability and high operation reliability. In addition, the present disclosure relates to a rod holder that is used in the lever connection body, and a handle apparatus for a vehicle that includes the lever connection body.

BRIEF DESCRIPTION OF DRAWING

FIG. 1(*b*) is a cross-sectional view taken along line 1B-1B in FIG. 1(*a*).

FIG. 2(*b*) is a view illustrating a connected state of the lever connection body in a state where a cylinder lock is unlocked. FIG. 2(*c*) is a back view of the FIG. 2(*b*).

FIG. 4(*b*) is a view illustrating a state in which a third lever is operated from the state of FIG. 4(*a*).

FIG. 5(*b*) is a view seen in 5B direction arrow of FIG. 5(*a*). FIG. 5(*c*) is a view seen in 5C direction arrow of FIG. 5(*a*). FIG. 5(*d*) is a view seen in 5D direction arrow of FIG. 5(*b*).

DESCRIPTION OF EMBODIMENTS

Hereinafter, an embodiment will be described with reference to the attached drawings. In addition, the attached drawings and the following disclosure are illustrative of the present disclosure. Accordingly, these are not intended to limit the subject matters described in the claims.

Figure 1A:
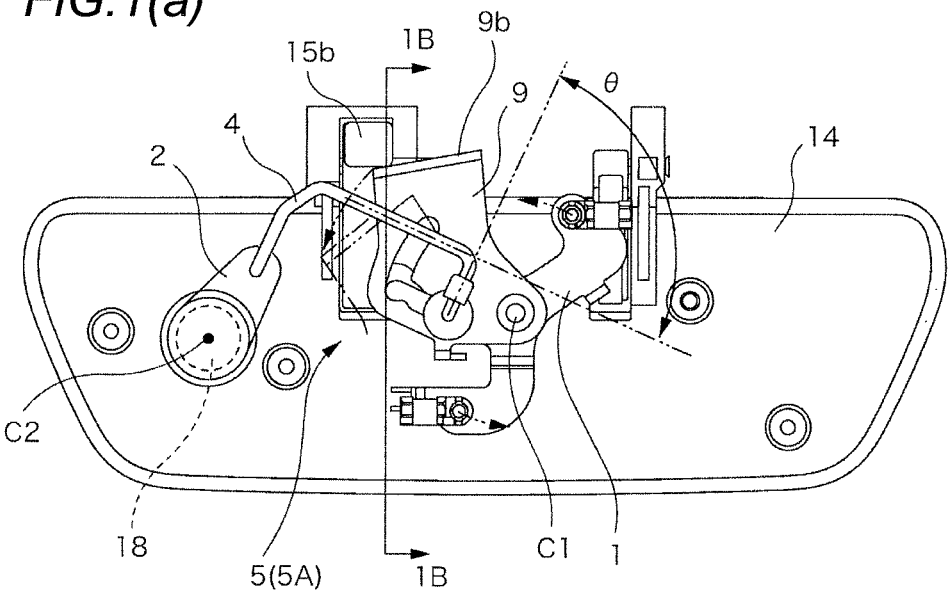
FIG. 1(*a*) is a rear view illustrating a handle apparatus.
Figure 1B:
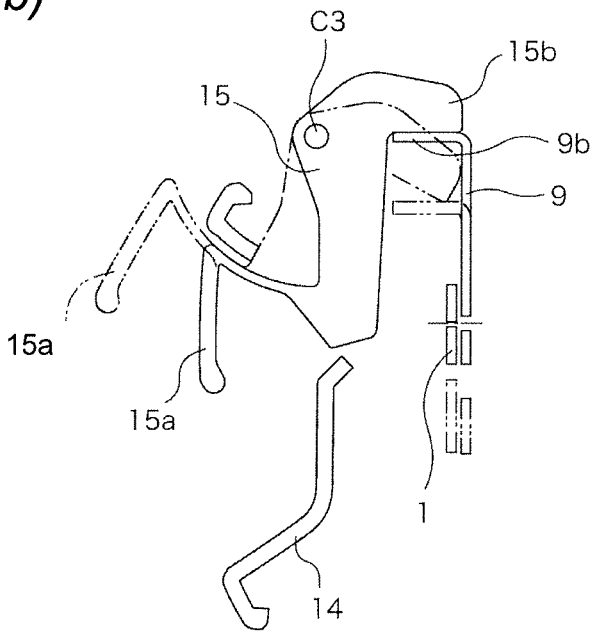

FIG. 1(*a*) and FIG. 1(*b*) are views illustrating a handle apparatus for a vehicle according to an embodiment. The handle apparatus is an outside handle apparatus that is fixed to a door outer wall surface of the vehicle to be used, and includes a handle base 14 that is fixed to a door, an operating handle 15 that is connected to the handle base 14 in a rotatable manner in a vertical direction from an initial rotation position which is illustrated by a solid line to an operating rotation position which is illustrated by a dot-dash line in FIG. 1(*b*), and a cylinder lock 18 that is fixed to the handle base 14 and is operated to be rotated between a locked rotational position and an unlocked rotational position.

The operating handle 15 is a so called pull up handle that is operated to be rotated by raising a working portion 15*a*. A pressing projection portion 15*b* is provided on the opposite of the working portion 15*a* with respect to a rotation center (C3) in the operating handle 15.

The second lever 2 that rotates according to a rotating operation of the cylinder lock 18 is connected to the cylinder lock 18 and the first lever 1 and the third lever 9 are rotatably connected about the same rotational axis (C1) in the handle base 14. The first lever 1 and the third lever 9, and the second lever 2 are connected by the rod 4. The first lever 1, the second lever 2, and the rod 4 constitute a first lever connection body 5A and a second lever connection body 5B is configured by adding the third lever 9 to the first lever connection body 5A.

Figure 2A:
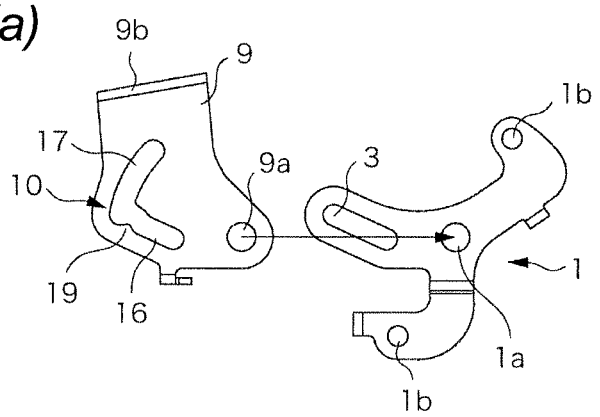
FIG. 2(*a*) is a view illustrating an exploded state of the lever connection body.
Figure 2B:
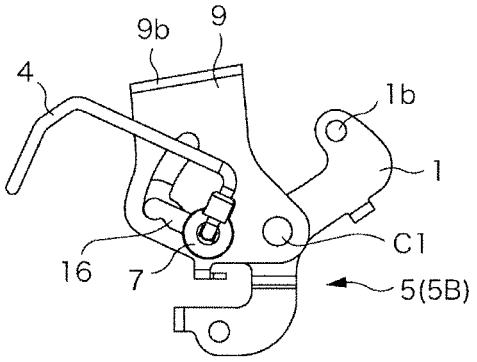
Figure 2C:
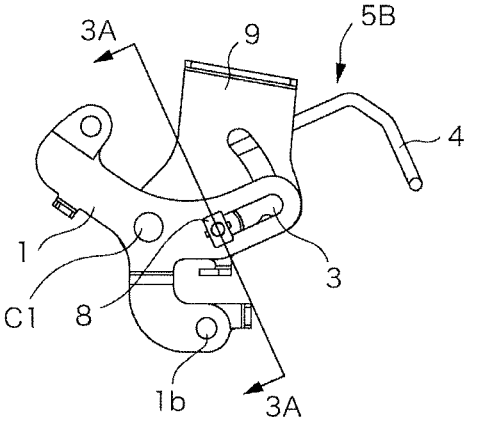

As illustrated in FIG. 2(*a*), the first lever 1 includes an output hole 1*b* that is opened at the position which is spaced apart by an appropriate interval from a shaft insertion hole 1*a* into which a rotating shaft member (not shown) fixed to the handle base 14 is inserted and a sliding long hole 3 that extends in the radial direction from the shaft insertion hole 1*a*. In the present example, two output holes 1*b* are provided in the positions symmetrical to the shaft insertion hole 1*a* so that the output hole freely corresponds regardless of a left side and a right side. A latch device which is fixed to the door is connected via a transmission member such as a cable device to any one of the two output holes 1*b*. Therefore, the latch is capable of being actuated by a rotation operation of the first lever 1.

On the other hand, the third lever 9 includes a shaft insertion hole 9*a* that is coaxially connected to the shaft insertion hole 1*a* of the first lever 1 and includes a driven folded piece 9*b* that is in contact with the pressing projection portion 15*b* of the operating handle 15 by bending a material end. When the operating handle 15 is operated to be rotated until the rotational operation position, the driven folded piece 9*b* is pushed downward to be rotated in the counter-clockwise direction in FIG. 1(*a*).

In addition, a rod mounting hole 10 is opened in the third lever 9. The rod mounting hole 10 includes a driving long hole 16 that matches the sliding long hole 3 of the first lever 1 when the first lever 1 and the third lever 9 are coaxially connected to each other, and an arc-shaped long hole 17 that is started from a centrifugal side end portion of the driving long hole 16. A detent projection portion 19 is projected at the boundary between the driving long hole 16 and the arc-shaped long hole 17.

The first lever 1 and the third lever 9 are connected to each other via a rod holder 7 so that the operating force of the operating handle 15 is transferred to the first lever 1 via the third lever 9. The rod holder 7 is mounted on the end portion of the rod 4 on the first lever 1 and the third lever 9 side. An L-shaped bent portion 11 for mounting the rod holder 7 is formed in the end portion of the rod 4.

The rod holder 7 is formed of a synthetic resin material by injection molding. As illustrated in FIG. 5(*a*) to FIG. 5(*d*), the rod holder 7 includes a support portion 12 that has a circular flange portion 12*a* on an end portion thereof and that supports a bent proximal end portion of the L-shaped bent portion 11 of the rod 4, an inserting projection portion 6 that is projected on the rear surface of the circular flange portion 12*a* of the support portion 12 and has a stopper 8 on the free end of the inserting projection portion 6, and an elastically locking portion 7*a* having a C-shaped cross-sectional shape that is formed on the surface of the opposite end to the circular flange portion 12*a* of the support portion 12 and that is elastically locked with the rod 4.

The inserting projection portion 6 has a circular cross-sectional shape of diameter size enough to be capable of being inserted into the sliding long hole 3 and the rod mounting hole 10 of the first lever 1 and the third lever 9 and includes a circular penetration hole shaped opening 13 into which the rod 4 is capable of being inserted in the center portion of the inserting projection portion 6. Further, a pair of elastically deformable locking pawls 7*b* is provided on the opposite position of the side wall portion of the inserting projection portion 6.

The stopper 8 has a rectangular shape that has a short side portion which has a diameter size of the inserting projection portion 6, that is a size capable of being inserted into the sliding long hole 3 and the rod mounting hole 10 of the first lever 1 and the third lever 9, and a long side length that has a length which is greater than the diameters of the sliding long hole 3 and the rod mounting hole 10. The stopper 8 is configured so that distance (d) between stopper 8 and a bottom surface of the support portion 12 is slightly longer than the thickness obtained by adding the thickness of the first lever 1 and the thickness of the third lever 9 to each other. A slide strip 7*c* is formed on an opposing surface to the support portion 12 of the stopper 8.

Thus, in this example, when the stopper 8 of the rod holder 7 is inserted from the rod mounting hole 10 of the third lever 9 and penetrates the sliding long hole 3 of the first lever 1 in a state where the first lever 1 and the third lever 9 are stacked about the common rotational axis (C1) in a rotatable manner, the locking pawls 7*b* of the rod holder 7 is elastically deformed once, and then is restored to be elastically locked with the peripheral edge of the sliding long hole 3 of the first lever 1 and is temporarily fixed to the first lever 1 and the third lever 9.

Figure 3:
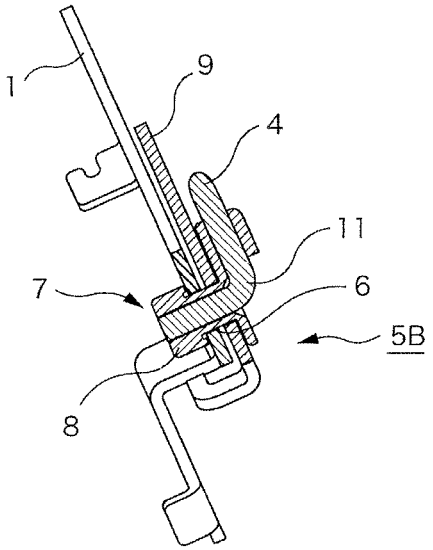
FIG. 3 is a cross-sectional view taken along line 3A-3A in FIG. 2(*c*).

From this state, the cylinder lock 18 is fixed to the handle base 14 and the free end of the L-shaped bent portion 11 of the rod 4 is inserted into the opening 13 of the rod holder 7 and then, when the proximal end portion of the L-shaped bent portion 11 is locked with the elastically locking portion 7*a*, as illustrated in FIG. 2(*c*) and FIG. 3, the first lever 1 and the third lever 9 are interposed between the circular flange portion 12*a* and the stopper 8 in the rod holder 7 by the rod 4. The long side portion of the stopper 8 is prevented from being withdrawn from the sliding long hole 3 by intersecting the long side portion of the stopper 8 and the sliding long hole 3.

Figure 4A:
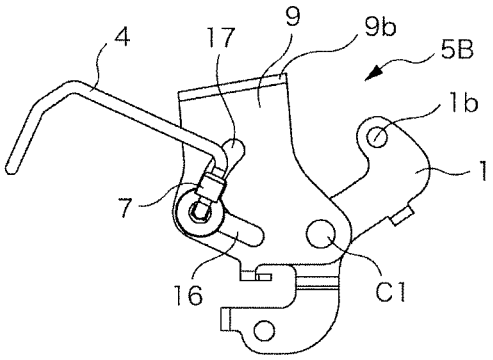
FIG. 4(*a*) is a view illustrating a connected state of the lever connection body in a state where a cylinder lock is locked.
Figure 4B:
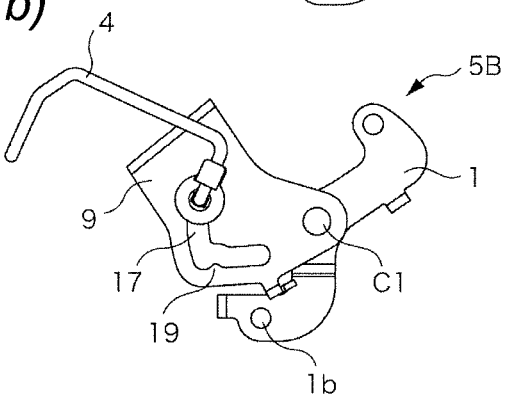
Figure 5A:
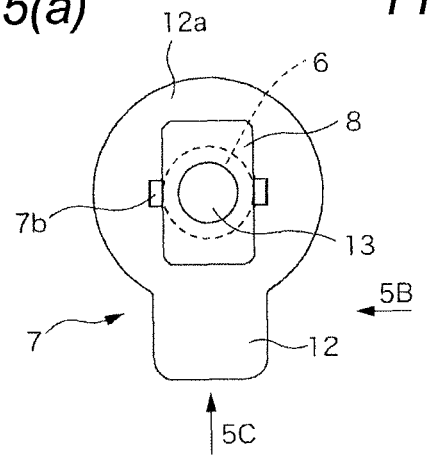
FIG. 5(*a*) is a plan view of a rod holder.
Figure 5B:
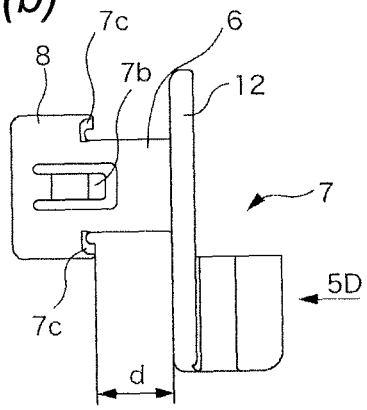
Figure 5C:
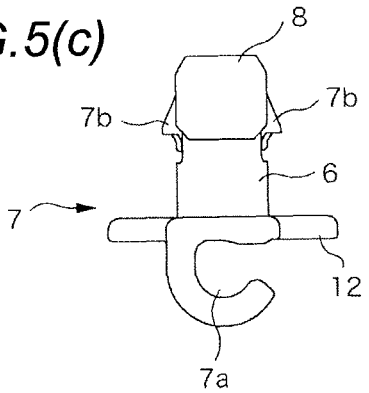
Figure 5D:
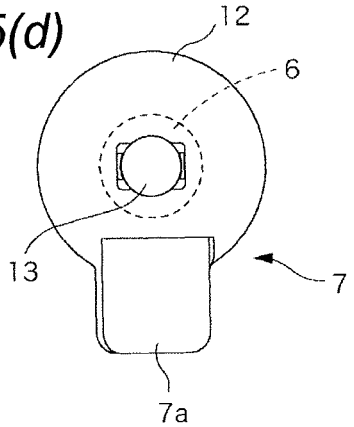

The position of the inserting projection portion 6 on the sliding long hole 3 and the rod mounting hole 10 of the first lever 1 and the third lever 9 that rotate on the same axis is determined by the position of the second lever 2, that is, the position of the cylinder lock 18 and the length of the rod 4, when the cylinder lock 18 is at an unlocking position, as illustrated in FIG. 2(*c*), the cylinder lock is positioned at the intersecting point between a centripetal side end portion of the sliding long hole 3 of the first lever 1 and a centripetal side terminal portion of the driving long hole 16 of the third lever 9, and when the cylinder lock 18 is at a locking position, as illustrated in FIG. 4(*a*), the cylinder lock is positioned at the boundary of a centrifugal side end portion of the sliding long hole 3 and a centrifugal side end portion of the driving long hole 16 of the third lever 9, that is, the boundary of the driving long hole 16 and arc-shaped long hole 17.

Thus, in this example, when the cylinder lock 18 is in the unlocking state, that is, when the inserting projection portion 6 is positioned at the end portions of the sliding long hole 3 and the driving long hole 16, if the third lever 9 is rotated by operating the operating handle 15 to be rotated, it is possible for the latch device to be operated by being pressed on a wall surface of the driving long hole 16 of the first lever 1 and rotating the first lever 1 following the third lever 9 while the inserting projection portion 6 is moved in a centrifugal direction.

On the other hand, when the cylinder lock 18 is operated to be rotated to the unlocking position, as illustrated in FIG. 4(*a*), the inserting projection portion 6 of the rod holder 7 is moved to the centrifugal side termination end of the sliding long hole 3 of the first lever 1, that is, to the proximal end portion of the arc-shaped long hole 17 of the third lever 9. When the inserting projection portion 6 is moved to the proximal end of the arc-shaped long hole 17 from the driving long hole 16 of the third lever 9, the inserting projection portion 6 needs to climb over the detent projection portion 19 disposed at the boundary portion by the inserting projection portion 6 being elastically deformed. Therefore, inadvertent movement of the inserting projection portion 6 is prevented.

In this state, although the third lever 9 is rotated by operating the operating handle 15 to rotate, since it is not possible for the inserting projection portion 6 to be moved by the arc-shaped long hole 17 being only relatively moved with respect to the inserting projection portion 6, the first lever 1 driven by the movement of the inserting projection portion 6 is not moved. Therefore, the latch operation is not actuated.

The movement of the inserting projection portion 6 within the sliding long hole 3 described above is performed by the slide strip 7*c* sliding on the surface of the first lever 1. Further, since the stopper 8 does not take a posture along the sliding long hole 3 during the entire movement stroke by the distal end portion of the rod 4 being bent (a bent angle θ in FIG. 1(*a*)), the withdrawal of the rod holder 7 from the first lever 1 and the third lever 9 is reliably prevented.

According to the present disclosure, the lever connection body 5 includes the first lever 1 and the second lever 2 that rotate about different rotation centers (C1 and C2) from each other. The sliding long hole 3 that is opened in the first lever 1 and the second lever 2 that is disposed to be spaced apart with respect to the sliding long hole 3 are connected to each other via the rod 4.

The rod holder 7 that includes the inserting projection portion 6 which is inserted into the sliding long hole 3 of the first lever 1 is mounted on the end portion of the rod 4 facing the first lever 1 side.

The rectangular stopper 8 which has the short side portion which is capable of being inserted into the sliding long hole 3 and the long side portion which is locked to the sliding long hole 3 to prevent the long side portion from being withdrawn from the sliding long hole 3 is provided in the distal end portion of the inserting projection portion 6 of the rod holder 7.

The rod holder 7 controls a posture in a direction in which the long side portion is locked to the sliding long hole 3 by the second lever 2.

The lever connection body 5 is formed by connecting via the rod 4 between the first lever 1 and the second lever 2 that rotate about the different rotation centers (C1, C2) from each other. Since relative rotation between the first lever 1 and the second lever 2 that rotate about the different rotation centers (C1, C2) from each other is possible, the sliding long hole 3 is opened in the first lever 1 and the rod holder 7 that includes the inserting projection portion 6 which is inserted into the sliding long hole 3 of the first lever is mounted on the distal end of the rod 4 facing the first lever 1 side.

The stopper 8 that has the short side portion which is capable of being inserted into the sliding long hole 3 is provided in the distal end portion of the inserting projection portion 6. The mounting of the rod 4 on the first lever is performed by the long side portion of the rod holder 7 being inserted into the sliding long hole 3 with the long side portion of the rod holder 7 taking a posture along the sliding long hole 3 and then by the long side portion being rotated about the center of the inserting projection portion 6 so that the long side portion crosses the sliding long hole 3.

According to the present disclosure, by the stopper 8 only being provided at a position in which the long side portion is locked to the sliding long hole 3 in the operating range of the second lever 2, it is possible to completely prevent the rod holder 7 from being withdrawn from the sliding long hole 3 during operation. Therefore, it is not necessary to mount a washer or the like.

In addition, the lever connection body may include the first lever 1, the third lever 9, and the rod 4.

The first lever 1 and the third lever 9 are disposed in a stacked shape and rotate about a common rotation center (C1).

The rod holder 7 that includes the inserting projection portion 6 which penetrates the rod mounting hole 10 opened in the third lever 9 and is inserted into the sliding long hole 3 opened in the first lever 1 is mounted on the distal end of the rod 4.

A rectangular stopper 8 that has a short side portion which is capable of being inserted into the sliding long hole 3 of the first lever 1 and a long side portion which is locked to the corresponding sliding long hole 3 and thus prevents the long side portion from being withdrawn from the sliding long hole 3 is provided in the distal end portion of the inserting projection portion 6 of the rod holder 7.

The rod holder 7 controls a posture in a direction in which the long side portion is locked to the sliding long hole 3 by the second lever 2 that is connected to the other end of the rod 4.

The lever connection body 5 has the first lever 1 and the third lever 9 that are stacked in a relatively rotatable manner about a common rotation center (C1) and are connected to each other via the rod holder 7 which is mounted on the rod 4. Since the relative rotation of the first lever 1 and the third lever 9 having a common rotation center is allowed, the sliding long hole 3 is opened in the first lever 1 and the inserting projection portion 6 of the rod holder 7 penetrates the rod mounting hole 10 of the third lever 9 and is inserted into the sliding long hole 3 of the first lever 1 and thus operations of the first lever 1 and the third lever 9 are associated with each other and withdrawal at the time of the stopper 8 that is formed on the inserting projection portion 6 is locked to the sliding long hole 3 so as to prevent the sliding.

If the stopper 8 is capable of being inserted into the rod mounting hole 10, the rod mounting hole 10 of the third lever 9 may be substantially the same size of a rectangular hole as the stopper 8 or may be a slidable long hole of which a long side size is extended.

According to the present disclosure, by the direction of the long side portion of the stopper 8 being set to the direction to lock to the sliding long hole 3 in consideration of the movement range of the second lever 2 and by a simple assembling operation, it is possible to obtain the lever connection body 5 that is capable of reliably preventing from being separated at the time of sliding operation.

Further, in the lever connection body 5, the rod holder 7 that is mounted on the L-shaped bent portion 11 formed on a distal end portion of the rod 4 and causes the rod 4 to be connected to the lever by inserting a inserting projection portion 6 into the sliding long hole 3 opened in the lever is useable.

The inserting projection portion 6 is projected from the support portion 12 that supports the proximal end of the L-shaped bent portion 11 of the rod 4 and an opening 13 in which the bent distal end of the rod 4 is lockable is provided in the inserting projection portion 6, the rectangular stopper 8 is provided in a distal end of the inserting projection portion 6, and the stopper has the short side portion which is capable of penetrating the sliding long hole 3 of the lever and the long side portion which is locked to the sliding long hole 3 so as to be withdrawn from the sliding long hole 3.

The handle apparatus may include the operating handle 15 that is connected to the handle base 14 in a rotatable operation manner, the first lever 1 in which the sliding long hole 3 extended in a normal direction to the rotation center (C1) on the handle base 14 is opened and is rotated about the rotation center (C1) to cause the latch device of a door to be actuated, the third lever 9 that has the same rotation center as the rotation center of the first lever 1, is stacked on the first lever 1 in a relatively rotatable manner, is included in a rod mounting hole 10 which is formed by extending an arc-shaped long hole 17 having the same center as the rotation center of the driving long hole 16 from the terminal end of the driving long hole 16 which matches the sliding long hole 3 of the first lever 1 and is driven to be rotated by the rotating operation of the operating handle 15, and the second lever 2 that is driven to be rotated by an operation of a cylinder lock 18 and is connected to the first lever 1 via the rod 4 on which the rod holder including an inserting projection portion 6 on the distal end is mounted. The inserting projection portion 6 penetrates the rod mounting hole 10 of the third lever 9 and is inserted into the sliding long hole 3 of the first lever 1.

The rod holder 7 causes a long side portion of a rectangular stopper 8 to be locked to the sliding long hole 3 so that the stopper prevents the long side portion from being withdrawn from the sliding long hole 3, the rectangular stopper 8 is provided in a distal end of the inserting projection portion 6, and the stopper has a short side portion which is capable of penetrating the sliding long hole 3 of the first lever 1.

The rod holder 7 prevents the operating force which is applied to the operating handle 15 from being transferred to the first lever 1 by transferring the inserting projection portion 6 into the arc-shaped long hole 17 of the third lever 9 by the locking operation of the cylinder lock 18.

The handle apparatus is configured to operate the latch device by the rotational operating force to the operating handle 15 that is connected to the handle base 14 being transferred to the third lever 9, the first lever 1, and the latch device. The inserting projection portion 6 of the rod holder 7 that is mounted on the rod 4 is inserted into the sliding long hole 3 that is opened in the first lever 1 and the rod mounting hole 10 that is opened in the third lever 9.

The sliding long hole 3 of the first lever 1 is formed as a long hole which is lengthened in the normal direction to the rotation center and the rod mounting hole 10 of the third lever 9 is formed by extending the arc-shaped long hole 17 having the same center as the rotation center of the driving long hole 16 from the terminal end of the driving long hole 16 which matches the sliding long hole 3. When the rod holder 7, more correctly the inserting projection portion 6 is positioned in the driving long hole 16 of the rod mounting hole 10, it is possible for the rotational operating force provided to the third lever 9 via the operating handle 15 to be transferred to the first lever 1, and when the inserting projection portion 6 is positioned in the arc-shaped section, the rotational movement of the third lever 9 is absorbed by the arc-shaped long hole 17 and thus the rotational movement is not transferred to the first lever 1.

In the present invention that disconnects transmission between the first lever 1 and the third lever 9 by connecting the rod 4 to the cylinder lock 18 and by controlling the position of the rod holder 7, it is possible to prevent the components from being broken due to excessive operation since the operating force of the operating handle 15 is not added to the first lever although the operating handle 15 is operated in the locked state.

In addition, since the withdrawal of the inserting projection portion 6 can be prevented by only connecting the rod 4 to the second lever 2 after the stopper 8 is inserted into the long hole at the time of an assembly operation, it is not necessary to interpose a separate washer or the like. Therefore, it is possible to improve assembling workability and to also increase operation reliability.

When a projection portion that provides resistance when the inserting projection portion 6 is moved is provided at a boundary between the arc-shaped long hole 17 of the third lever 9 and the driving long hole 16, it is possible to reliably prevent a locking operation and unlocking operation from being unstable due to the inserting projection portion 6 of the rod holder 7 inadvertently moving between the arc-shaped long hole 17 and the driving long hole 16 by the presence of the dimensional errors of the rod 4 or the like.

According to the present disclosure, it is possible to improve assembling workability and to also increase operation reliability.

This application is based on Japanese Patent Application No. 2014-059589 filed on Mar. 24, 2014, the contents of which are incorporated herein by reference.

REFERENCE SIGNS LIST

1: first lever
2: second lever
3: sliding long hole
4: rod
5: lever connection body
6: inserting projection portion
7: rod holder
8: stopper
9: third lever
10: rod mounting hole
11: L-shaped bent portion
12: support portion
13: opening
14: handle base
15: handle body
16: driving long hole
17: arc-shaped long hole
18: cylinder lock
19: detent projection portion
C1, C2: rotation center

The invention claimed is:

1. A handle apparatus for a vehicle, comprising:

an operating handle connected to a handle base and rotatable relative to the handle base;

a first lever having a sliding long hole that extends in a substantially normal direction to a rotation center of the first lever on the handle base, wherein the first lever having the sliding long hole is rotated about the rotation center so as to operate a latch device of a door, a third lever sharing the rotation center of the first lever, being stacked on the first lever, and rotatable about the rotation center, the third lever including a rod mounting hole comprising (i) an arc-shaped long hole having the same center as the rotation center and a first end portion and a second end portion, (ii) a driving long hole which overlaps with the sliding long hole of the first lever and has a third end portion and a fourth end portion, the arc-shaped long hole extending from a terminal end of the driving long hole, and (iii) a detent projection portion projected at a point where the arc-shaped long hole extends from the terminal end of the driving long hole, wherein the second end portion of the arc-shaped long hole and the third end portion of the driving long hole are connected, and the detent projection portion is projected from the point at which the arc-shaped long hole extends from the terminal end of the driving long hole in a direction extending toward the first end portion of the arc-shaped long hole, wherein the third lever is driven to rotate by the rotation of the operating handle relative to the handle base; and a second lever driven to rotate by an operation of a cylinder lock, and connected to the first lever via a rod on which a rod holder, including an inserting projection portion on a distal end portion thereof, is mounted, the inserting projection portion of the rod holder penetrates the rod mounting hole of the third lever and is inserted into the sliding long hole of the first lever, wherein the rod holder further comprises a rectangular stopper having at least one locking element on at least one long side portion thereof for locking the inserting projection portion of the rod holder in the sliding long hole, wherein the rectangular stopper is formed on the distal end portion of the inserting projection portion and has at least one short side portion for allowing the inserting projection portion to be inserted into the sliding long hole of the first lever, and wherein rotation of the second lever causes movement of the rod, and thereby movement of the inserting projection portion of the rod holder into the arc-shaped long hole of the third lever by the operation of the cylinder lock so as to prevent an operating force applied to the operating handle from being transferred to the first lever.

2. The handle apparatus for a vehicle of claim 1, wherein the detent projection portion of the rod mounting hole gives resistance to movement of the inserting projection portion within the rod mounting hole.

* * * * *